US008356546B2

(12) United States Patent
Matsuo et al.

(10) Patent No.: US 8,356,546 B2
(45) Date of Patent: Jan. 22, 2013

(54) HOLDING CONTROL VALVE

(75) Inventors: Masahiro Matsuo, Akashi (JP); Makoto Ito, Kobe (JP); Noboru Ito, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 933 days.

(21) Appl. No.: 12/410,259

(22) Filed: Mar. 24, 2009

(65) Prior Publication Data

US 2009/0241765 A1 Oct. 1, 2009

(30) Foreign Application Priority Data

Mar. 31, 2008 (JP) ..... 2008-094358

(51) Int. Cl.
*F15B 11/044* (2006.01)
*F15B 13/01* (2006.01)

(52) U.S. Cl. ..... 91/447; 91/450; 91/461

(58) Field of Classification Search ..... 91/447, 91/450, 461
See application file for complete search history.

(56) References Cited

U.S. PATENT DOCUMENTS

| | | | | |
|---|---|---|---|---|
| 6,253,658 | B1 * | 7/2001 | Kimura | 91/447 |
| 6,409,142 | B1 * | 6/2002 | Kariya et al. | 251/44 |

FOREIGN PATENT DOCUMENTS

| | | | |
|---|---|---|---|
| DE | 197 01 114 | A1 | 7/1998 |
| DE | 19701114 | A1 * | 7/1998 |
| EP | 1143151 | A1 | 10/2001 |
| FR | 2 479 358 | A1 | 10/1981 |
| JP | 3919399 | | 2/2007 |

OTHER PUBLICATIONS

Extended European Search Report for European Application No. 09003972.8-2422, dated Feb. 23, 2010.

* cited by examiner

*Primary Examiner* — Thomas E Lazo

(74) *Attorney, Agent, or Firm* — Marshall, Gerstein & Borun LLP

(57) ABSTRACT

A holding control valve of the present invention is configured such that: a spool is configured to perform strokes by a piston configured to operate by introduction of pilot pressure and have a larger diameter than the spool; the piston is divided into a pilot piston configured to receive the pilot pressure and a relief operation piston disposed adjacent to the spool to receive pressure of relief oil discharged when a relief valve operates; and the relief oil is introduced to between the pilot piston and the relief operation piston.

5 Claims, 8 Drawing Sheets

HOLDING CONTROL VALVE

BACKGROUND OF THE INVENTION

1. Field of the Invention

The present invention relates to a holding control valve for use in, for example, a hydraulic control circuit which activates an activated body (cylinder device) of a hydraulic operation apparatus, such as a hydraulic shovel.

2. Description of the Related Art

A typical related art is disclosed in, for example, Patent Document 1, Japanese Patent No. 3919399. Patent Document 1 discloses a hydraulic control circuit for controlling the hydraulic operation apparatus, such as the hydraulic shovel, including the holding control valve. This hydraulic control circuit includes: a pump; a control valve communicated with the pump; a pilot check valve connected to the control valve via a load supporting pipe; and a cylinder device having a pressure chamber connected to the pilot check valve.

The pilot check valve is provided with a back pressure chamber which is communicated with the pressure chamber of the cylinder device. The control valve is configured to block the cylinder device from the pump when it is at a neutral position, introduce discharged oil of the pump to the pressure chamber of the cylinder device to move up a load when it switches to an up position, and discharge the hydraulic oil of the pressure chamber of the cylinder device to move down the load when it switches to a down position. Further, a pilot pressure controller (operating lever) is provided which controls a pilot pressure by which the control valve switches to the up position or the down position. When the pressure of the back pressure chamber of the pilot check valve is a load pressure of the pressure chamber of the cylinder device, the flow of the hydraulic oil from the pressure chamber side of the cylinder device is blocked by the pilot check valve. When the hydraulic oil of the back pressure chamber of the pilot check valve is discharged, the pilot check valve opens to allow the flow of the hydraulic oil from the pressure chamber side of the cylinder device.

Then, the hydraulic control circuit further includes: a connecting passage which connects between the pressure chamber of the cylinder device and the pilot check valve; a first switching device which blocks the connecting passage when it is a normal state and opens the connecting passage and causes the pressure chamber of the cylinder device and the load supporting pipe to be communicated with each other via a throttle when it is a switched state; and a second switching device which maintains the pressure of the back pressure chamber of the pilot check valve at the load pressure of the pressure chamber of the cylinder device when it is a normal state and discharges the hydraulic oil of the back pressure chamber when it is a switched state, and is configured such that: the first and second switching devices switch by the pilot pressure by which the control valve switches to the down position; only the first switching device switches when the pilot pressure is a predetermined pressure or lower; and both the first switching device and the second switching device switch when the pilot pressure exceeds the predetermined pressure.

Each of the first and second switching devices is constituted by a switching valve configured to causes a spool to operate against a spring force (pressure) by introducing the pilot pressure from the control valve. Moreover, a relief valve is disposed on a branched passage which branches from the connecting passage connecting between the pressure chamber of the cylinder device and the pilot check valve. A relief oil exit side of the relief valve is connected to a drain tank via a throttle member, and the relief valve branches on an upstream side of the throttle member to be communicated with a pilot pressure introducing portion side spool hole of the switching valve.

With this configuration, in a case where an external force is applied to the cylinder device when the load of the cylinder device is maintained at a constant pressure, i.e., when the control valve is maintained at a normal state, the load pressure of the pressure chamber of the cylinder device increases, and this causes the relief valve to operate, so that the relief oil flows out from the relief valve. Pressure rises on the upstream side of the throttle member by the existence of the throttle member on a flow-out side (exit side) of the relief valve. The pressure rising on the upstream side of the throttle member is introduced to the spool hole. An introducing port through which the pressure is introduced from the relief valve to the spool hole is located at an adjacent portion which is adjacent to the spool and the piston located close to the spool. The pressure of the relief oil introduced from the relief valve to the spool hole acts on the spool and the piston at this adjacent portion. Therefore, the spool and the piston move so as to separate from each other, and the second switching device of the switching valve switches, so that the oil of the pressure chamber of the cylinder device is Patent Document 1: Japanese Patent No. 3919399.

FIG. 7 is a diagram conceptually showing the configuration of a portion including the pilot pressure introducing portion and relief oil introducing portion in the switching valve incorporated in the hydraulic control circuit. In FIG. 7, a spool C is fittingly inserted in and supported by a spool hole B of a switching valve A so as to be slidable along an axis line of the spool hole B. A plug D threadedly engages with one end of the spool hole B, so that the end of the spool hole B is sealed. A piston E having a larger diameter than the spool C is disposed between the plug D and the spool C. An airspace between the piston E and the plug D functions as a pressure receiving portion which receives a pilot pressure P introduced from the control valve (not shown). Moreover, relief oil G1 from a relief valve G connected to a cylinder device F is introduced to an airspace between the piston E and the spool C, and this airspace portion functions as a pressure receiving portion which receives pressure at the time of a relief operation. The piston E is provided with a communication passage E1 extending from the pressure receiving portion of the pilot pressure P to the pressure receiving portion used at the time of the relief operation, and the communication passage E1 includes an orifice E2 at a portion thereof.

The configuration of the switching valve and the configuration of the hydraulic control circuit other than the portion including the introducing portions shown in FIG. 7 are substantially the same as those shown in FIG. 2 of Patent Document 1 and those shown in FIG. 1, so that explanations thereof are omitted.

In the switching valve configured as above, the piston E is pressed upward by the introduced pilot pressure P, and the spool C is then pressed by the large-diameter piston E, so that the first switching device switches. If the pilot pressure P further increases to exceed a predetermined pressure, the second switching device also switches together with the first switching device. Moreover, when the relief oil G1 is introduced, the oil pressure of the relief oil G1 is applied to the spool C, so that the second switching device switches. Then, when the cylinder device F becomes a high load (high pressure) state, pre-leakage (phenomenon in which the flow rate of oil flowing therethrough increases at a pressure equal to or lower than a set pressure) occurs in the relief valve G, and pressure loss by the throttle member occurs. Since the oil pressure against the pilot pressure is generated by the occurrence of the pressure loss, the switching valve does not follow the pilot pressure, and opening start points of the first and second switching devices are inappropriate.

FIG. 8 is a graph showing actual measurement results of a relation among the pilot pressure P, a cylinder port pressure, and a flow rate of oil flowing through the switching valve and the pilot check valve when the pilot pressure P is applied in a simulation in which the pressure of 30 MPa is generated on a bottom side of the cylinder device. In FIG. 8, each solid line denotes changes in flow rate of oil flowing through the switching valve and the pilot check valve, and each broken line denotes changes in cylinder port pressure. As can be understood by FIG. 8, in a case where the flow rate increases, it less changes even after the pilot pressure exceeds 1 MPa that is a set value of the opening point, and it starts increasing from about 1.6 MPa, and in a case where the flow rate decreases, it does not become 0 L/min even after the pilot pressure falls below 1 MPa. This means that a following capability of the flow rate with respect to the pilot pressure P is low and the opening start point is inappropriate.

SUMMARY OF THE INVENTION

The present invention addresses the above described conditions, and an object of the present invention is to provide a holding control valve which includes a pilot check valve, a switching valve, and a relief valve, and whose opening start point does not become inappropriate.

A holding control valve according to the present invention is a holding control valve for use in a hydraulic control circuit configured to activate an activated body, including: a pilot check valve connected to a pressure chamber of the activated body; a switching valve configured to cause a spool to move against a spring force by introduction of pilot pressure in order to cause the pilot check valve to prevent flow of hydraulic oil from the pressure chamber of the activated body when pressure of a back pressure chamber of the pilot check valve is a load pressure of the pressure chamber of the activated body and in order to cause the pilot check valve to open to allow the flow of the hydraulic oil from the pressure chamber of the activated body when the hydraulic oil of the back pressure chamber of the pilot check valve is discharged; and a relief valve which is disposed on a branched passage branching from a connecting passage connecting the pressure chamber of the activated body and the pilot check valve, and whose relief oil exit is connected to a pilot pressure introducing portion of the switching valve, wherein: the spool is configured to perform strokes by a piston configured to operate by the introduction of the pilot pressure and have a larger diameter than the spool; the piston is divided into a pilot piston configured to receive the pilot pressure and a relief operation piston disposed adjacent to the spool to receive pressure of relief oil discharged when the relief valve operates; and the relief oil is introduced to between the pilot piston and the relief operation piston.

Moreover, the relief operation piston may have a same diameter as the spool, and may be stored in a tubular portion formed on the pilot piston having a larger diameter than the spool.

Moreover, a horizontal hole may be formed on a tubular wall constituting the tubular portion of the pilot piston, and the relief oil may be introduced through the horizontal hole to between the pilot piston and the relief operation piston.

Moreover, the pilot piston and the relief operation piston may have a same diameter as each other, and may be arranged so as to be lined up.

Moreover, a communication passage including an orifice may be formed to extend from a surface of the pilot piston which surface receives the pilot pressure to a surface of the relief operation piston which surface faces the spool.

The above and further objects and features of the invention will more fully be apparent from the following detailed description with accompanying drawings.

BRIEF DESCRIPTION OF T DRAWINGS

DESCRIPTION OF THE PREFERRED EMBODIMENTS

Figure 1:
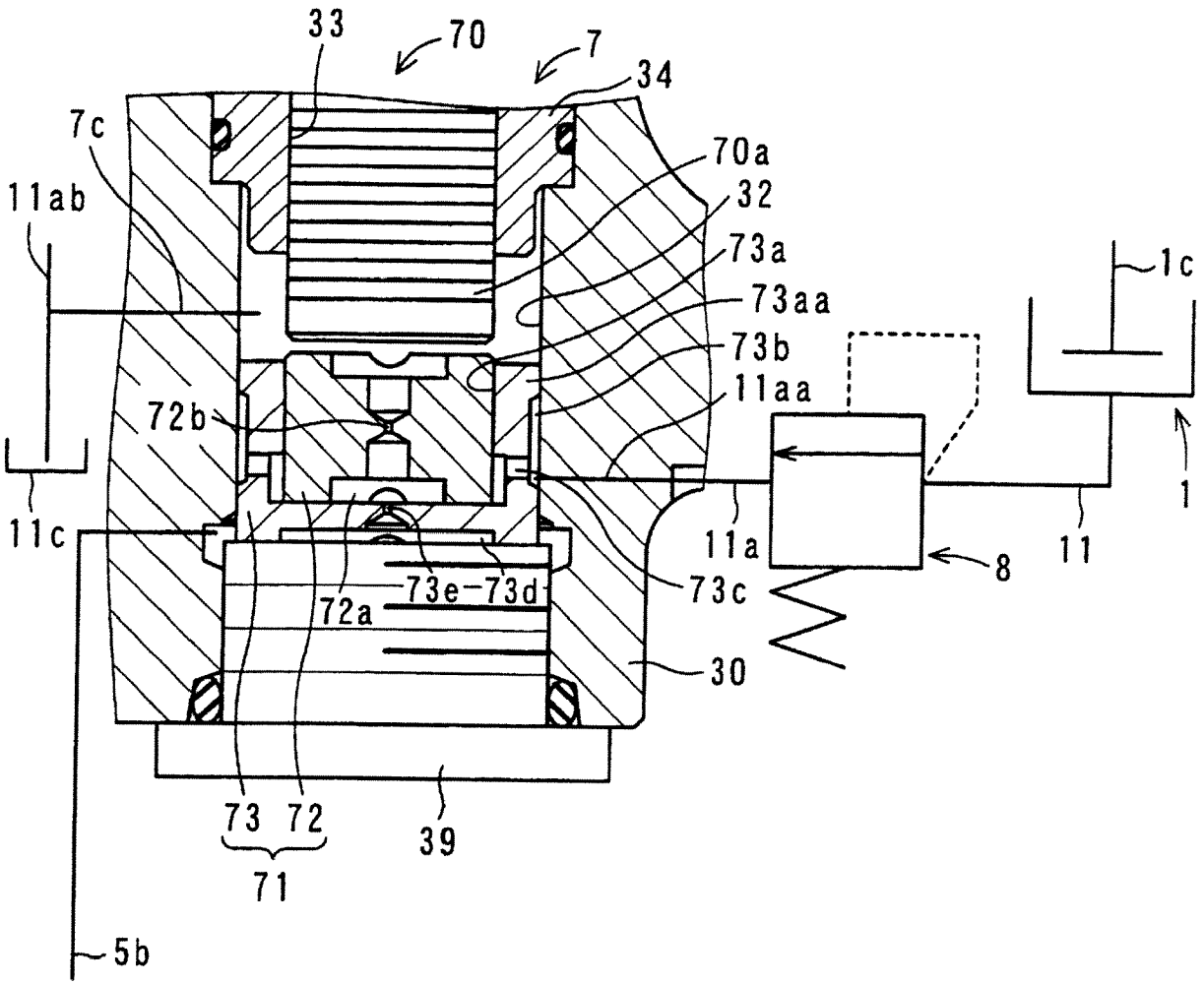
FIG. 1 is a cross-sectional view of a part of a holding control valve 3 according to one embodiment of the present invention.
Figure 2:
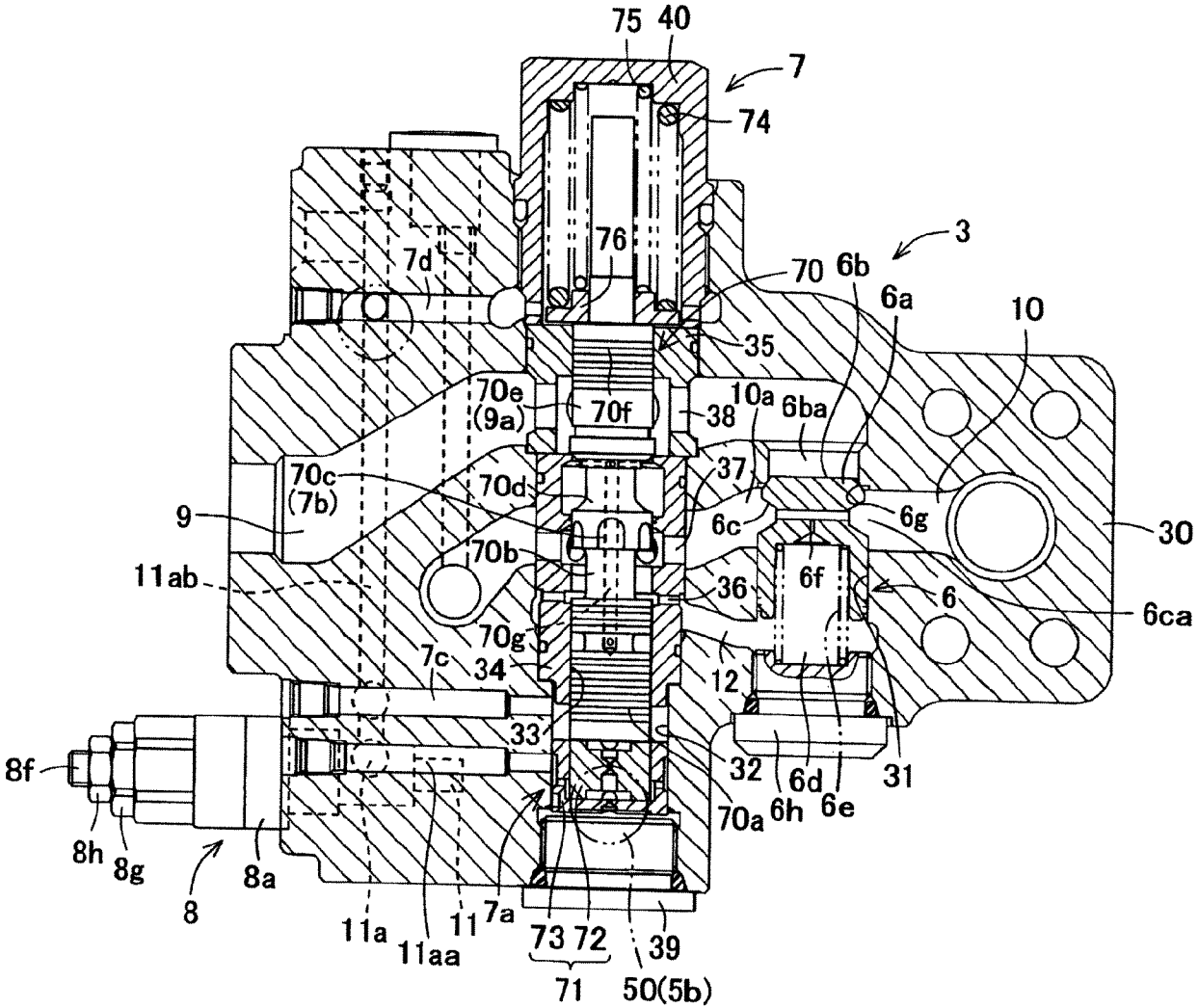
FIG. 2 is a cross-sectional view showing an entire configuration of the holding control valve 3.
Figure 3:
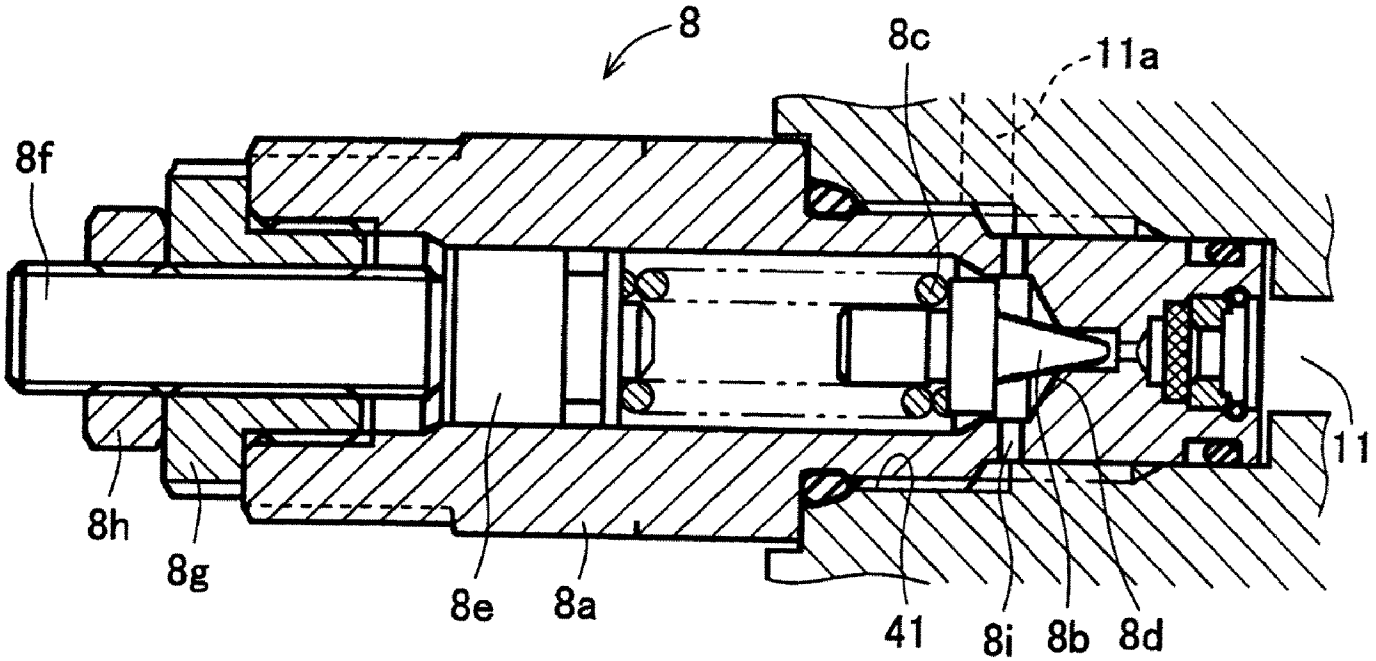
FIG. 3 is an enlarged cross-sectional view of a relief valve 8 of the holding control valve 3.
Figure 4:
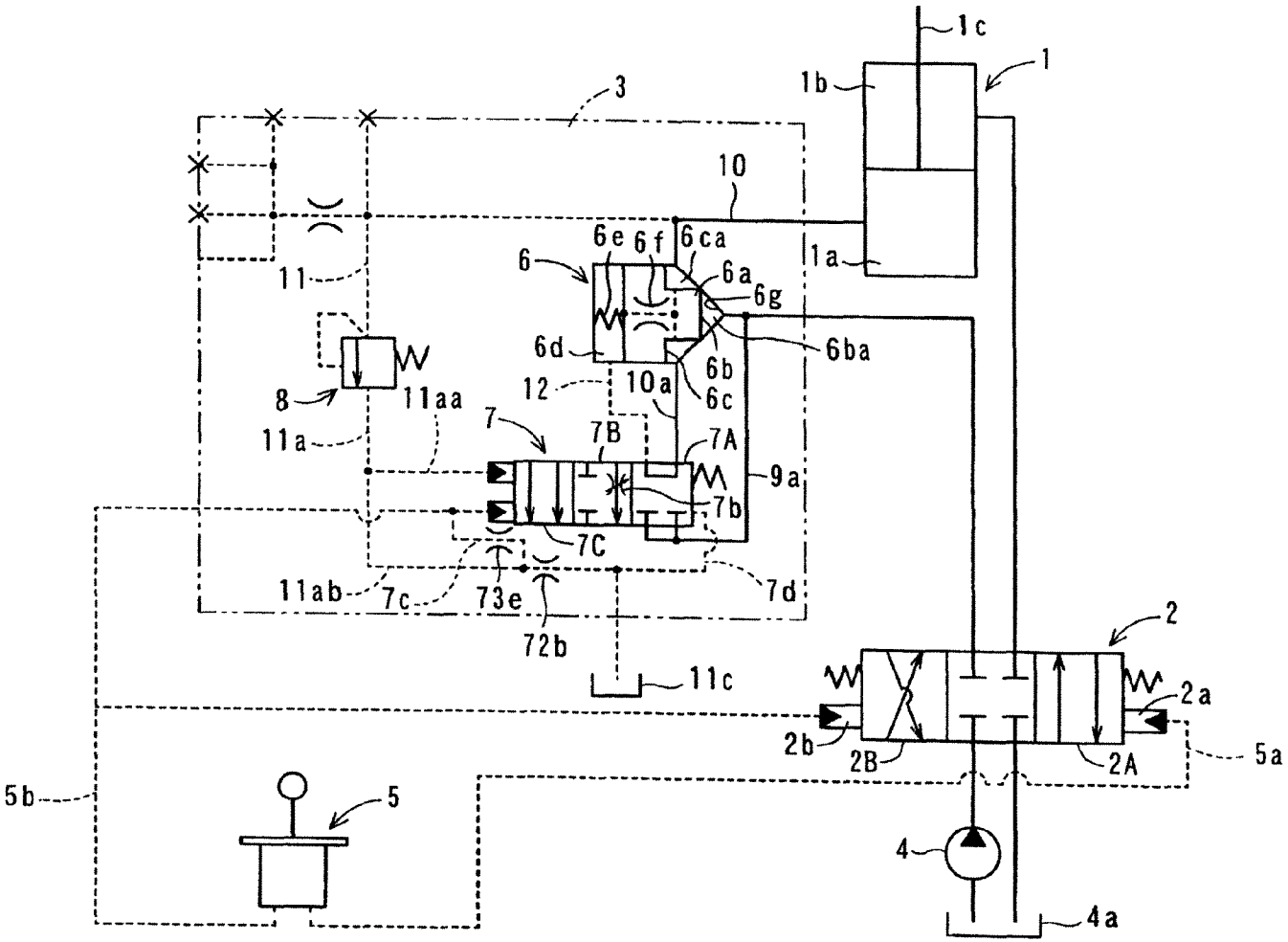
FIG. 4 is a hydraulic circuit diagram of a drive controller including the holding control valve 3.

FIG. 1 is a cross-sectional view of a part of a holding control valve 3 according to one embodiment of the present invention. FIG. 2 is a cross-sectional view showing an entire configuration of the holding control valve 3 shown in FIG. 1. FIG. 3 is an enlarged cross-sectional view of a relief valve 8 of the holding control valve 3. FIG. 4 is a hydraulic circuit diagram of a drive controller including the holding control valve 3.

One embodiment of a holding control valve of the present invention will be explained in reference to FIGS. 1 to 4. FIG. 4 is the hydraulic circuit diagram of the drive controller configured to include the holding control valve and drive an activated body. First, the drive controller will be explained. The drive controller is configured to control a hydraulic operation apparatus, such as a hydraulic shovel. A hydraulic pump 4 is connected to the activated body, i.e., a cylinder device 1 via a control valve 2 and the holding control valve 3. The hydraulic pump 4 discharges and supplies hydraulic oil stored in an oil tank 4*a* to a bottom side pressure chamber 1*a* of the cylinder device 1 or a rod side pressure chamber 1*b* of the cylinder device 1.

The control valve 2 is configured to switch by oil pressure (hereinafter referred to as "pilot pressure") of the pilot oil introduced to pilot chambers 2*a* and 2*b*. In the case of, for example, the hydraulic shovel, an operating lever (pilot valve) 5 is operated by an operator, and pilot pressures 5*a* and 5*b* introduced to the pilot chambers 2*a* and 2*b*, respectively, are controlled by operating the operating lever 5. For example, by introducing the pilot pressure 5*a* to the pilot chamber 2*a*, the control valve 2 switches to an up position 2A for causing the cylinder device 1 to move up in proportion to the magnitude of the pilot pressure 5*a*. In contrast, by introducing the pilot pressure 5*b* to the pilot chamber 2*b*, the control valve 2 switches to a down position 2B for causing the cylinder device 1 to move down in proportion to the magnitude of the pilot pressure 5*b*.

The holding control valve 3 is disposed between the control valve 2 and the bottom side pressure chamber 1*a* of the cylinder device 1. The holding control valve 3 includes a pilot check valve 6, a switching valve 7, and the relief valve 8. The pilot check valve 6 includes a valve member 6*a*. A tip end of the valve member 6*a* is a first pressure receiving surface 6*b*, and a side surface of the valve member 6*a* is a second pressure receiving surface 6*c*. A back pressure chamber 6*d* is formed on a rear surface of the valve member 6*a*, and a spring 6*e* is stored in the back pressure chamber 6*d*. The valve member 6*a* is pressed on a valve seat 6*g* by a spring force of the spring 6*e*. The back pressure chamber 6*d* and a pressure receiving chamber 6*ca* located on the second pressure receiving surface 6*c* side are communicated with each other via a throttle passage 6*f*.

A pressure receiving chamber 6*ba* located on the first pressure receiving surface 6*b* side in the holding control valve 3 and the control valve 2 are connected to each other by a load supporting pipe 9. The load supporting pipe 9 is also communicated with the switching valve 7 via a branched load supporting pipe 9*a*.

Moreover, the bottom side pressure chamber 1*a* of the cylinder device 1 and the pressure receiving chamber 6*ca* located on the second pressure receiving surface 6*c* side in the holding control valve 3 are connected to each other by a connecting passage 10. The connecting passage 10 is communicated with an extended passage 10*a* which connects the pressure receiving chamber 6*ca* located on the second pressure receiving surface 6*c* side with the switching valve 7, and therefore, is communicated with the switching valve 7 via the extended passage 10*a*. Further, the back pressure chamber 6*d* and the switching valve 7 are connected to each other by a pilot passage 12.

The relief valve 8 is disposed on a portion of a branched passage 11. A relief oil exit side branched passage 11*a* located on a relief oil exit side of the relief valve 8 is connected to a pilot pressure introducing portion (pilot chamber) 7*a* side of the switching valve 7. The switching valve 7 includes three switching positions that are a block position 7A, a first communication position 7B, and a second communication position 7C. At the block position 7A, both the extended passage 10*a* of the connecting passage 10 and the pilot passage 12 are closed. At the first communication position 7B, the pilot passage 12 remains closed, but the extended passage 10*a* is communicated with the branched load supporting pipe 9*a* of the load supporting pipe 9 via a variable throttle valve 7*b*. At the second communication position 7C, both the pilot passage 12 and the extended passage 10*a* are communicated with the branched load supporting pipe 9*a*.

The pilot pressure 5*b* generated by operating the operating lever 5 can be introduced to the pilot chamber 7*a* of the switching valve 7. When the switching valve 7 is a normal state, it is located at the block position. When the pilot pressure 5*b* that is a predetermined pressure or lower is introduced to the pilot chamber 7*a*, the switching valve 7 switches to the first communication position 7B. Further, when the pilot pressure 5*b* that exceeds the predetermined pressure is introduced to the pilot chamber 7*a*, or when the pressure of the relief oil from the below-described relief valve 8 is applied in addition to the pilot pressure 5*b*, and the total of the pressure of the relief oil and the pilot pressure 5*b* exceeds the predetermined pressure, the switching valve 7 switches to the second communication position 7C. In FIG. 4, the pilot pressure 5*b* is introduced to the pilot chamber 7*a* through two passages. The relief oil exit side branched passage 11*a* located on the relief oil exit side of the relief valve 8 is further divided into two passages 11*aa* and 11*ab*. The passage 11*aa* is communicated with the pilot chamber 7*a* of the switching valve 7, and the passage 11*ab* is communicated with the drain tank 11*c* via a throttle member 72*b*. Moreover, the pilot chamber 7*a* and a portion of the passage 11*ab* which portion is located upstream of the throttle member 72*b* are connected to each other by a connecting passage 7*c*. Thus, the pilot chamber 7*a* is also communicated with the drain tank 11*c* via the throttle member 72*b*.

When the control valve 2 is located at a neutral position in the hydraulic control circuit shown in FIG. 4, the hydraulic oil in the oil tank 4*a* is not discharged or supplied by the pump 4 to the bottom side pressure chamber 1*a* and rod side pressure chamber 1*b* of the cylinder device 1. Moreover, since the pilot pressure 5*b* is not introduced to the pilot chamber 7*a* of the switching valve 7, the switching valve 7 is located at the block position 7A. Therefore, the pressure of the back pressure chamber 6*d* of the pilot check valve 6 becomes substantially equal to the load pressure of the bottom side pressure chamber 1*a* of the cylinder device 1, and this state is maintained. On this account, the valve member 6*a* of the pilot check valve 6 is pressed on the valve seat 6*g* by a total pressure of the load pressure of the back pressure chamber 6*d* and an elastic force of the spring 6*e* in the back pressure chamber 6*d*, the hydraulic oil is prevented from flowing out from the bottom side pressure chamber 1*a* of the cylinder device 1, and a load disposed on the cylinder device 1, i.e., a load disposed on a rod 1*c* of the cylinder device 1 is surely supported.

In order to move up the load disposed on the cylinder device 1, the operating lever 5 is operated to introduce the pilot pressure 5*a* to the pilot chamber 2*a* of the control valve 2. By introducing the pilot pressure 5*a*, the control valve 2 switches to the up position 2A. After the control valve 2 switches to the up position 2A, the hydraulic oil in the oil tank 4*a* is discharged and supplied by the pump 4 through the load supporting pipe 9 to the pressure receiving chamber 6*ba* of the pilot check valve 6, and discharge pressure of the hydraulic oil acts on the first pressure receiving surface 6*b* of the valve member 6*a* of the pilot check valve 6. At this time, since the switching valve 7 is located at the block position 7A, the above-described total pressure in the back pressure chamber 6*d* of the pilot check valve 6 is substantially equal to the load pressure of the bottom side pressure chamber 1*a* of the cylinder device 1, and the valve member 6*a* of the pilot check valve 6 is pressed on the valve seat 6*g*. However, when the pressure of the oil discharged by the pump 4 which acts on the first pressure receiving surface 6*b* becomes higher than the total pressure in the back pressure chamber 6*d*, the valve member 6*a* separates from the valve seat 6*g*, the hydraulic oil is supplied through the pilot check valve 6 and the connecting passage 10 to the bottom side pressure chamber 1*a* of the cylinder device 1, the cylinder device 1 moves up against the load, and therefore, the hydraulic oil in the rod side pressure chamber 1*b* is discharged to the oil tank 4*a*.

In order to move down the load disposed on the cylinder device 1, the operating lever 5 is operated to introduce the pilot pressure 5*b* to the pilot chamber 2*b* of the control valve 2. By introducing the pilot pressure 5*b*, the control valve 2 switches to the down position 2B. After the control valve 2 switches to the down position 2B, the hydraulic oil is discharged and supplied by the pump 4 to the rod side pressure chamber 1*b* of the cylinder device 1. By supplying the hydraulic oil to the rod side pressure chamber 1*b*, the load pressure of the bottom side pressure chamber 1*a* increases. At this time, since the pilot pressure 5*b* is also introduced to the pilot chamber 7*a* of the switching valve 7, the switching valve 7 switches to the first communication position 7B or the second communication position 7C. To be specific, when the pilot pressure 5*b* introduced to the pilot chamber 7*a* is lower than predetermined pressure, the switching valve 7 switches to the first communication position 7B. Since the pilot passage 12 remains closed when the switching valve 7 is located at the first communication position 7B, the total pressure of the back pressure chamber 6*d* of the pilot check valve 6 is maintained to be substantially equal to the load pressure of the bottom side pressure chamber 1*a* of the cylinder device 1. Therefore, the valve member 6*a* of the pilot check valve 6 is maintained to be pressed on the valve seat 6*g*, so that the hydraulic oil is prevented from flowing out from the bottom side pressure chamber 1*a* of the cylinder device 1.

However, when the switching valve 7 is located at the first communication position 7B, the extended passage 10*a* which connects the pressure receiving chamber 6*ca* located on the second pressure receiving surface 6*c* side in the pilot check valve 6 and the switching valve 7 is communicated with the branched load supporting pipe 9*a* via the variable throttle valve 7*b*. With this, a passage is formed which extends from the bottom side pressure chamber 1*a* of the cylinder device 1 through the pilot check valve 6, the branched load supporting pipe 9*a*, and the load supporting pipe 9 to the control valve 2 and the oil tank 4*a*. Therefore, by suitably adjusting an opening degree of the variable throttle valve 7*b* and an opening degree of the control valve 2, the hydraulic oil in the bottom side pressure chamber 1*a* in which the load pressure is increased is discharged through the branched load supporting pipe 9*a* and the load supporting pipe 9 to the oil tank 4*a* while maintaining a state where the valve member 6*a* is pressed on the valve seat 6*g*. Thus, the cylinder device 1 is caused to move down. In this case, since discharging of the hydraulic oil is controlled by the variable throttle valve 7*b*, the cylinder device 1 can slowly move down.

When the pilot pressure 5*b* introduced to the pilot chamber 7*a* of the switching valve 7 exceeds the predetermined pressure by increasing the opening degree of the control valve 2 (or when the total of the pilot pressure 5*b* and the pressure of the below-described relief oil exceeds the predetermined pressure), the switching valve 7 switches to the second communication position 7C. When the switching valve 7 is located at the second communication position 7C, both the pilot passage 12 and the extended passage 10*a* of the connecting passage 10 are communicated with the branched load supporting pipe 9*a* and the load supporting pipe 9. Therefore, a pressure difference is generated between upstream and downstream of the throttle passage 6*f* of the pilot check valve 6, so that the total pressure in the back pressure chamber 6*d* decreases by this pressure difference. When a force acting on the second pressure receiving surface 6*c* by the load pressure of the bottom side pressure chamber 1*a* of the cylinder device 1 exceeds the total pressure in the back pressure chamber 6*d*, the valve member 6*a* separates from the valve seat 6*g*. After the valve member 6*a* separates from the valve seat 6*g*, the hydraulic oil in the bottom side pressure chamber 1*a* of the cylinder device 1 is discharged through the pilot check valve 6, the load supporting pipe 9, and the control valve 2 to the oil tank 4*a*.

Regarding the above move-down operation of the cylinder device 1, a relation between a switching mode in which the switching valve 7 switches to the first communication position 7B and the second communication position 7C and an operation mode in which the cylinder device 1 is practically used will be briefly explained. For example, in the case of an operation of moving down a target by the hydraulic shovel, the target needs to be moved down slowly. To be specific, the pilot pressure 5*b* introduced to the pilot chamber 2*b* of the control valve 2 and the pilot chamber 7*a* of the switching valve 7 by operating the operating lever 5 needs to be the predetermined pressure or lower. By operating the operating lever 5, the control valve 2 switches to the down position 2B. However, since the oil pressure of the pilot pressure 5*b* is low, the opening degree at the down position 2B is low, so that the switching valve 7 switches to the first communication position 7B. At this time, the pressure of the hydraulic oil discharged and supplied to the rod side pressure chamber 1*b* of the cylinder device 1 is low. In addition, when the switching valve 7 is located at the first communication position 7B, the hydraulic oil in the bottom side pressure chamber 1*a* of the cylinder device 1 is discharged little by little through the branched load supporting pipe 9*a* and the load supporting pipe 9 to the oil tank 4*a* while maintaining a state where the valve member 6*a* of the pilot check valve 6 is pressed on the valve seat 6*g*. Therefore, this move-down operation by discharging the hydraulic oil is slowly carried out.

In contrast, in the case of digging or smoothing a ground surface by the hydraulic shovel, the cylinder device 1 needs to quickly operate, and therefore, the flow rate of the hydraulic oil discharged needs to be high. On this account, the pilot pressure 5*b* introduced to the pilot chamber 2*b* of the control valve 2 exceeds the predetermined pressure by operating the operating lever 5, so that the opening degree of the control valve 2 having switched to the down position 2B becomes high. In addition, since the pilot pressure 5*b* introduced to the pilot chamber 7*a* of the switching valve 7 also exceeds the predetermined pressure, the switching valve 7 switches to the second communication position 7C. As a result of switching of the switching valve 7 to the second communication position 7C, the valve member 6*a* of the pilot check valve 6 separates from the valve seat 6*g*, so that the hydraulic oil in the bottom side pressure chamber 1*a* of the cylinder device 1 is discharged through the pilot check valve 6, the load supporting pipe 9, and the control valve 2 to the oil tank 4*a*. Since the hydraulic oil flows out or is discharged from the bottom side pressure chamber 1*a* of the cylinder device 1 when the valve member 6*a* of the pilot check valve 6 separates from the valve seat 6*g*, it flows out or is discharged at a high flow rate. Therefore, flowing-out or discharging of the hydraulic oil can correspond to the high flow rate of the hydraulic oil discharged and supplied to the rod side pressure chamber 1*b* and the high load applied on the bottom side pressure chamber 1*a*.

Moreover, in a case where an external force is applied to a load when the rod 1*c* of the cylinder device 1 is supporting a load, i.e., when the control valve 2 is located at the neutral position, the load pressure of the bottom side pressure chamber 1*a* of the cylinder device 1 increases. By the increase in the load pressure of the bottom side pressure chamber 1*a*, the relief valve 8 opens which is connected to the bottom side pressure chamber 1*a* via the connecting passage 10 and the branched passage 11. The relief oil flows out from the relief valve 8 to the relief oil exit side branched passage 11*a*. However, since a throttle member 11*b* is provided downstream of the relief oil exit side branched passage 11*a*, the pressure loss occurs upstream of the throttle member 11*b*, and the relief oil having pressure reduced by this pressure loss is introduced from the passage 11*aa* to the pilot chamber 7*a* of the switching valve 7. In this case, the total of the pressure of the relief oil and the pilot pressure 5*b* is set to exceed the predetermined pressure when the pressure of the relief oil is applied to the pilot pressure 5*b*. Therefore, the switching valve 7 switches to the second communication position 7C. After the switching valve 7 switches to the second communication position 7C, as described above, the valve member 6*a* of the pilot check valve 6 separates from the valve seat 6*g*, so that the hydraulic oil in the bottom side pressure chamber 1*a* of the cylinder device 1 is discharged through the pilot check valve 6, the load supporting pipe 9, and the control valve 2 to the oil tank 4*a*.

As above, even in a case where the external force is applied to the load when the rod 1*c* of the cylinder device 1 is supporting the load, an operation corresponding to the external force is accurately carried out by the operation of the relief valve 8. However, at the time of high pressure by the application of the external force, the throttle pressure loss occurs by the pre-leakage (phenomenon in which the flow rate of oil flowing therethrough increases at a pressure equal to or lower than a set pressure) of the relief valve 8, the oil pressure against the pilot pressure 5*b* is generated, the switching valve 7 does not follow the pilot pressure 5*b*, and the opening start timing at which the valve member 6*a* of the pilot check valve 6 separates from the valve seat 6*g* is sometimes inappropriate. The present invention solves this problem, and a specific configuration thereof will be described later.

FIGS. 2 and 3 show specific configurations of the holding control valve 3 and the relief valve 8 incorporated in the hydraulic control circuit. As described above, the holding control valve 3 shown in FIG. 2 includes the pilot check valve 6, the switching valve 7, and the relief valve 8 as major components, and these components are mounted on a body 30 to form peripheral pipes and the like. The valve member 6*a* is slidably stored in a pilot check valve hole 31 formed on the body 30. The back pressure chamber 6*d* is formed on the rear surface of the valve member 6*a*, and a spring receiving member 6*h* for attaching the spring 6*e* in the back pressure chamber 6*d* threadedly engages with an opening of the hole 31 of the body 30. The valve member 6*a* is pressed toward a tip side (upper side) by the elastic force of the spring 6*e*, and is pressed on the valve seat 6*g* formed on a hole wall of the hole 31. A tip end surface of the valve member 6*a* is the first pressure receiving surface 6*b*, and is communicated via the pressure receiving chamber 6*ba* with the load supporting pipe 9 formed on the body 30. A side peripheral surface of the valve member 6*a* is the second pressure receiving surface 6*c*, and is communicated with the connecting passage 10 via the pressure receiving chamber 6*ca*. Then, the back pressure chamber 6*d* and the pressure receiving chamber 6*ca* located on the second pressure receiving surface 6*c* side are communicated with each other via the throttle passage 6*f*. Thus, the pilot check valve 6 is formed.

A switching valve through hole 32 is formed on the body 30 so as to extend in parallel with the hole 31. Two bushes 34 and 35 including a spool hole 33 and three ports 36, 37, and 38 are hermetically and fittingly inserted in the through hole 32 so as to be lined up along an axial direction of the through hole 32. A lower end of the through hole 32 is sealed by a plug 39 which threadedly engages therewith, and an upper end of the through hole 32 is sealed by a spring receiving member 40 which threadedly engages therewith. A spool 70 is slidably and fittingly inserted in the spool hole 33. A space between a lower end of the spool 70 and the plug 39 is the pilot chamber 7*a*, and a piston 71 for causing the spool 70 to perform strokes is incorporated in the pilot chamber 7*a*. The piston 71 is constituted by a combined piston including a relief operation piston 72 having the same diameter as the spool 70 and a pilot piston 73 having a larger diameter than the spool 70. In FIG. 2, the relief operation piston 72 is stored in a tube portion 73*a* of the pilot piston 73 (also see FIG. 1).

An introducing port 50 through which the pilot pressure 5*b* is introduced is formed on the body 30. The pilot pressure 5*b* introduced through the introducing port 50 is introduced to between the pilot piston 73 and the plug 39 to act on the pilot piston 73. A peripheral groove 73*b* is formed on an outer peripheral portion of the pilot piston 73, and a horizontal hole 73*c* which causes the peripheral groove 73*b* and the tube portion 73*a* to be communicated with each other is formed on a tube wall 73*aa* of the tube portion 73*a* (also see FIG. 1). The passage 11*aa* extending from the relief oil exit side branched passage 11*a* of the relief valve 8 is communicated with the peripheral groove 73*b*, and the pressure of the relief oil introduced from the passage 11*aa* is introduced to between the pilot piston 73 and the relief operation piston 72 to act on the pilot piston 73 and the relief operation piston 72. Further, an airspace between the lower end of the spool 70 and an upper end of the piston 71 in the pilot chamber 7*a* is communicated with the connecting passage 7*c* connected to the passage 11*ab* located upstream of the throttle member 11*b*. Thus, the airspace is communicated with the drain tank 11*c* via these components (see FIGS. 1 and 4). Detailed configurations and detailed functions of the pilot chamber 7*a* and the piston 71 will be described later.

Two springs 74 and 75 are disposed in the spring receiving member 40 such that a washer member 76 is interposed between the spool 70 and the spring 74, 75, and elastically press the spool 70 toward the piston 71 side. The spool 70 is constituted by a solid columnar member. The spool 70 includes: a pilot pressure applied portion 70*a* facing the pilot chamber 7*a*; an annular groove portion 70*b*; a notch portion 70*c* formed adjacent to the annular groove portion 70*b* and constituting the variable throttle valve 7*b*; a small diameter portion 70*d* forming a circulation space interposed between the small diameter portion 70*d* and the inner wall of the bush 34; a relay portion 70*e* which forms the load supporting pipe 9 communicated with the pressure receiving chamber 6*ba* of the pilot check valve 6 via the port 38; a spring pressure receiving portion 70*f* which receives the elastic forces of the springs 74 and 75; and a connecting passage 70*g* formed in the core portion of the spool 70 so as to connect from an upper portion peripheral surface of the pilot pressure applied portion 70*a* to an upper side peripheral surface of the small diameter portion 70*d*, and these components 70*a* to 70*g* are arranged in this order from a lower end side of the spool 70 as shown in FIG. 2. By the existence of the relay portion 70*e*, the branched load supporting pipe 9*a* is practically formed.

The spool 70 in FIG. 2 shows that the switching valve 7 is located at the block position 7A. In this state, the pilot passage 12 communicated with the back pressure chamber 6*d* of the pilot check valve 6 and the extended passage 10*a* communicated with the pressure receiving chamber 6*ca* are communicated with each other via the port 36, the annular groove portion 70*b*, and the port 37, but the pilot passage 12 and the branched load supporting pipe 9*a* are not communicated with each other, and the extended passage 10*a* and the branched load supporting pipe 9*a* are not communicated with each other. When the switching valve 7 switches to the first communication position 7B, the spool 70 slightly moves up. Thus, the port 36 is blocked by the pilot pressure applied portion 70*a*, and the port 37 is communicated with the port 38 via the notch portion 70*c* constituting the variable throttle valve 7*b*. Since one end of the connecting passage 70*g* is sealed by the bush 34 when the switching valve 7 is located at the block position 7A and the first communication position 7B, the connecting passage 70*g* is not functioning. However, when the spool 70 further moves up, and therefore, the switching valve 7 switches to the second communication position 7C, the port 36 and the port 38 are communicated with each other via the connecting passage 70*g*, and the port 37 is communicated with the port 38 via the notch portion 70*c* constituting the variable throttle valve 7*b*. A positional relation among the ports 36, 37, and 38 and the respective components of the spool 70 is set so as to correspond to the switching mode of the switching valve 7. Note that an inside of the spring receiving member 40 is communicated with the drain tank 11*c* via a discharge passage 7*d* to allow a scroll operation of the spool 70.

Next, the relief valve 8 will be explained in reference to the above drawings and FIG. 3. A relief valve attachment internal screw hole 41 is formed on a side portion of the body 30, and is communicated with the branched passage 11 formed on the body 30. A valve main body 8*a* threadedly engages with and is fixed to the internal screw hole 41. A poppet 8*b* is incorporated in the valve main body 8*a*, and is pressed on a valve seat 8*d* by the elastic force of a spring 8*c*. When the pressure of the relief oil supplied through the branched passage 11 exceeds the elastic force of the spring 8*c*, the poppet 8*b* separates from the valve seat 8*d*.

The spring 8*c* is interposed between a spring receiving member 8*e* slidably disposed in a hollow portion of the valve main body 8*a* and the poppet 8*b*. A pressing member 8*f* that is an external screw member is disposed on a rear surface of the spring receiving member 8*e*. The pressing member 8*f* threadedly engages with lock nuts 8*g* and 8*h*, so that it is positionally fixed to the valve main body 8*a*. The elastic force of the spring 8*c* is adjustable by adjusting the position of the pressing member 8*f* fixed by the lock nuts 8*g* and 8*h*. An outlet port 8*i* is formed on the valve main body 8*a*. When the poppet 8*b* separates from the valve seat 8*d*, the relief oil flows out through the outlet port 8*i* to the relief oil exit side branched passage 11*a* formed on the body 30.

The relief oil exit side branched passage 11*a* further branches into two passages 11*aa* and 11*ab*. The passage 11*aa* is communicated with the pilot chamber 7*a* of the switching valve 7, and the passage 11*ab* is communicated with the drain tank 11*c* via the throttle member 11*b* (see FIG. 4). Therefore, the pressure loss of the relief oil having flowed out from the relief valve 8 occurs upstream of the throttle member 11*b*, and the relief oil having the pressure reduced by this pressure loss is introduced from the passage 11*aa* to the pilot chamber 7*a* of the switching valve 7.

FIG. 1 conceptually shows the pilot chamber 7*a* of the switching valve 7 and its peripheral portions. The lower end of the through hole 32 formed on the body 30 is sealed by the plug 39. The bottomed tubular pilot piston 73 whose upper surface is open is fitted into the pilot chamber 7*a* located above the plug 39 so as to be vertically movable. A lower surface of the pilot piston 73 is a surface which receives the pilot pressure. A concave portion 73*d* that is a pilot oil storing space is formed between the lower surface of the pilot piston 73 and an upper surface of the plug 39. The pilot pressure 5*b* is introduced to the concave portion 73*d*. The tube portion 73*a* of the pilot piston 73 is formed to have an internal diameter which is substantially the same as or slightly larger than an outer diameter of the relief operation piston 72. The relief operation piston 72 having substantially the same diameter as the spool 70 is stored in the tube portion 73*a* so as to be vertically movable. The peripheral groove 73*b* is formed on the outer peripheral portion of the pilot piston 73, and the horizontal hole 73*c* which causes the peripheral groove 73*b* and the tube portion 73*a* to be communicated with each other is formed on the tube wall 73*aa* of the tube portion 73*a*. The peripheral groove 73*b* is communicated with the passage 11*aa* extending from the relief oil exit side branched passage 11*a* of the relief valve 8.

A lower surface of the relief operation piston 72 is a surface which receives the oil pressure of the relief oil. A concave portion 72*a* that is a relief oil storing space is formed between the lower surface of the relief operation piston 72 and an inner bottom surface of the pilot piston 73. The relief oil is introduced from the relief valve 8 through the passage 11 aa, the peripheral groove 73*b*, and the horizontal hole 73*c* to the concave portion 72*a*. Further, a passage (orifice passage) 73*e* including an orifice is formed between the concave portion 73*d* and tube portion 73*a* of the pilot piston 73, and a passage (orifice passage) 72*b* including an orifice is formed between the concave portion 72*a* and upper surface of the relief operation piston 72. These two orifice passages 73*e* and 72*b* constitute a communication passage extending from the surface of the pilot piston 73 which surface receives the pilot pressure 5*b* to a surface of the relief operation piston 72 which surface faces the spool 70. Further, an airspace between the lower end of the spool 70 and the upper surface of the relief operation piston 72 in the pilot chamber 7*a* is communicated with the connecting passage 7*c* connected to the passage 11*ab*. Thus, the airspace is communicated with the drain tank 11*c* via these components.

With this configuration, when the pilot pressure 5*b* acts on the pilot piston 73, the pilot piston 73 is pressed upward together with the relief operation piston 72 to cause the spool 70 to perform strokes. When the pilot pressure 5*b* is the predetermined pressure or lower, the amount of stroke of the spool 70 is small, so that the switching valve 7 switches to the first communication position 7B, and the communication of the above-described ports is realized. Moreover, when the pilot pressure 5*b* exceeds the predetermined pressure, the amount of stroke of the spool 70 is large, so that the switching valve 7 switches to the second communication position 7C. Further, when the oil pressure of the relief oil supplied from the relief valve 8 acts on the relief operation piston 72, and the total of the oil pressure and the pilot pressure 5*b* exceeds the predetermined pressure, the amount of stroke of the spool 70 is large, so that the switching valve 7 switches to the second communication position 7C. This operation is effectively carried out since the piston 71 has a larger diameter than the spool 70.

As above, the piston 71 is divided into the pilot piston 73 which receives the pilot pressure 5*b* and the relief operation piston 72 which receives the oil pressure of the relief oil at the time of the relief operation. As a result, when the relief valve 8 is activated, the relief oil having flowed out from the relief valve 8 flows through the horizontal hole 73*c* of the pilot piston 73, reaches the upper surface of the relief operation piston 72 through the concave portion 72*a* and the orifice passage 72*b*, and is discharged through the connecting passage 7*c* to the drain tank 11*c*. When the oil pressure generated by the pilot pressure 5*b* acts on the pilot piston 73 in a state where the pre-leakage of the relief valve 8 occurs, and the oil pressure acts on the relief operation piston 72 by the pressure loss of the throttle member 11*b*, the oil pressure (oil pressure which acts on between both pistons 72 and 73) of the relief oil becomes an internal force in a state where the oil pressure acting on the pilot piston 73 and the total of the elastic forces of the springs 74 and 75 opposing the oil pressure via the spool 70 are balanced. Thus, the oil pressure of the relief oil does not become a force against the pilot pressure 5*b*. Therefore, even in a high pressure state by which the pre-leakage of the relief valve 8 occurs, it is possible to cause the opening start point of the pilot check valve 6 to follow the pilot pressure 5*b*, and stable handleability can be realized regardless of a load condition of the cylinder device 1. Then, as in the present embodiment, by storing the relief operation piston 72 in the tube portion 73*a* of the pilot piston 73, it is possible to realize an axially-compact configuration.

Figure 5:
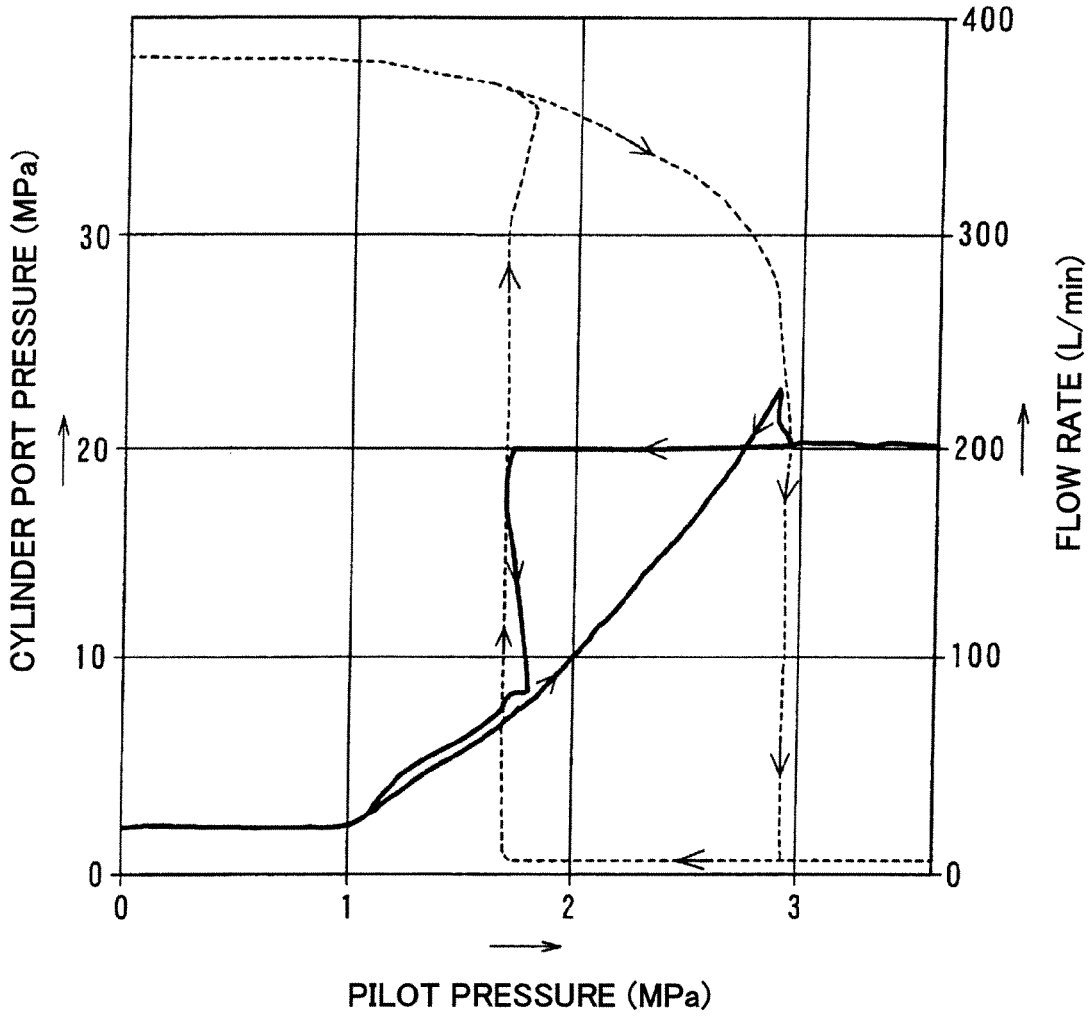
FIG. 5 is a graph showing actual measurement results of a relation among a pilot pressure P, a cylinder port pressure, and a flow rate of oil flowing through a switching valve and a pilot check valve, when the pilot pressure P is applied in a simulation in which the pressure of 38 MPa is generated on a bottom side of the cylinder device.

FIG. 5 is a graph showing actual measurement results of a relation among the pilot pressure P, a cylinder port pressure, the flow rate of oil flowing through the switching valve and the pilot check valve, when the pilot pressure P is applied in a simulation in which the pressure of 38 MPa is generated on a bottom side of the cylinder device. In FIG. 5, each solid line denotes changes in flow rate of oil flowing through the switching valve and the pilot check valve, and each broken line denotes changes in cylinder port pressure. As can be understood by FIG. 5, in a case where the flow rate increases, it starts increasing from 1 MPa that is the set value of the opening point, and in a case where the flow rate decreases, it becomes 0 L/min at 1 MPa. This means that the following capability of the flow rate with respect to the pilot pressure P is excellent, and the opening start point is not inappropriate.

Figure 6:
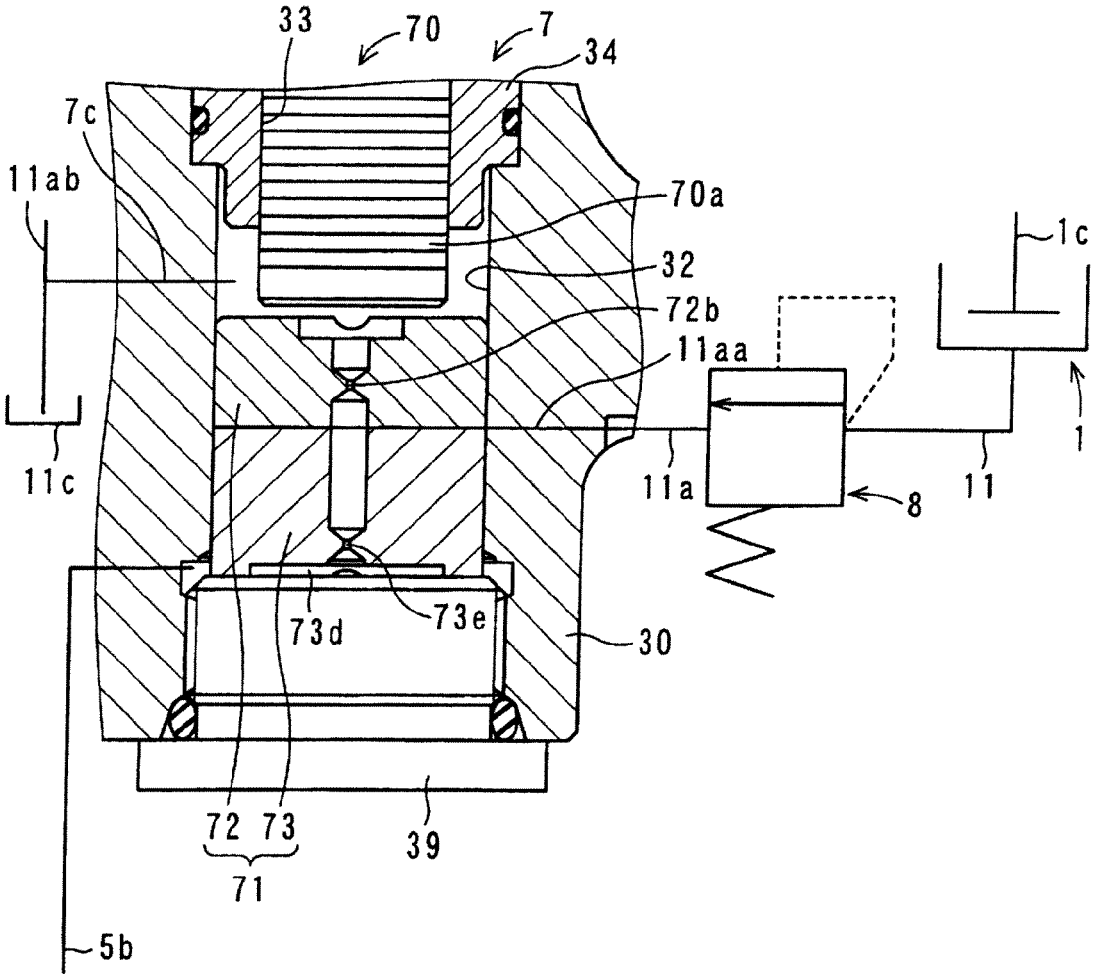
FIG. 6 is a cross-sectional view of a part of the holding control valve according to another embodiment of the present invention.
Figure 7:
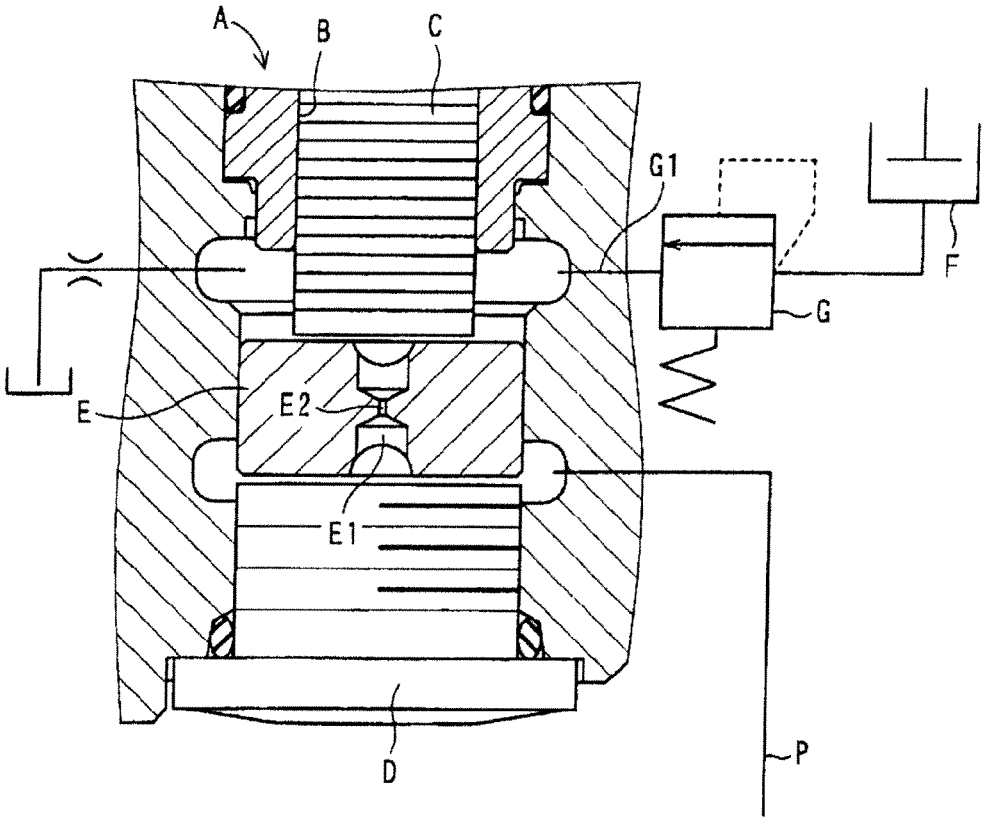
PRIOR ART Fig. 7
FIG. 7 is similar to FIG. 1, and is a diagram showing configurations of a pilot pressure introducing portion and relief oil introducing portion of a conventional switching valve.
Figure 8:
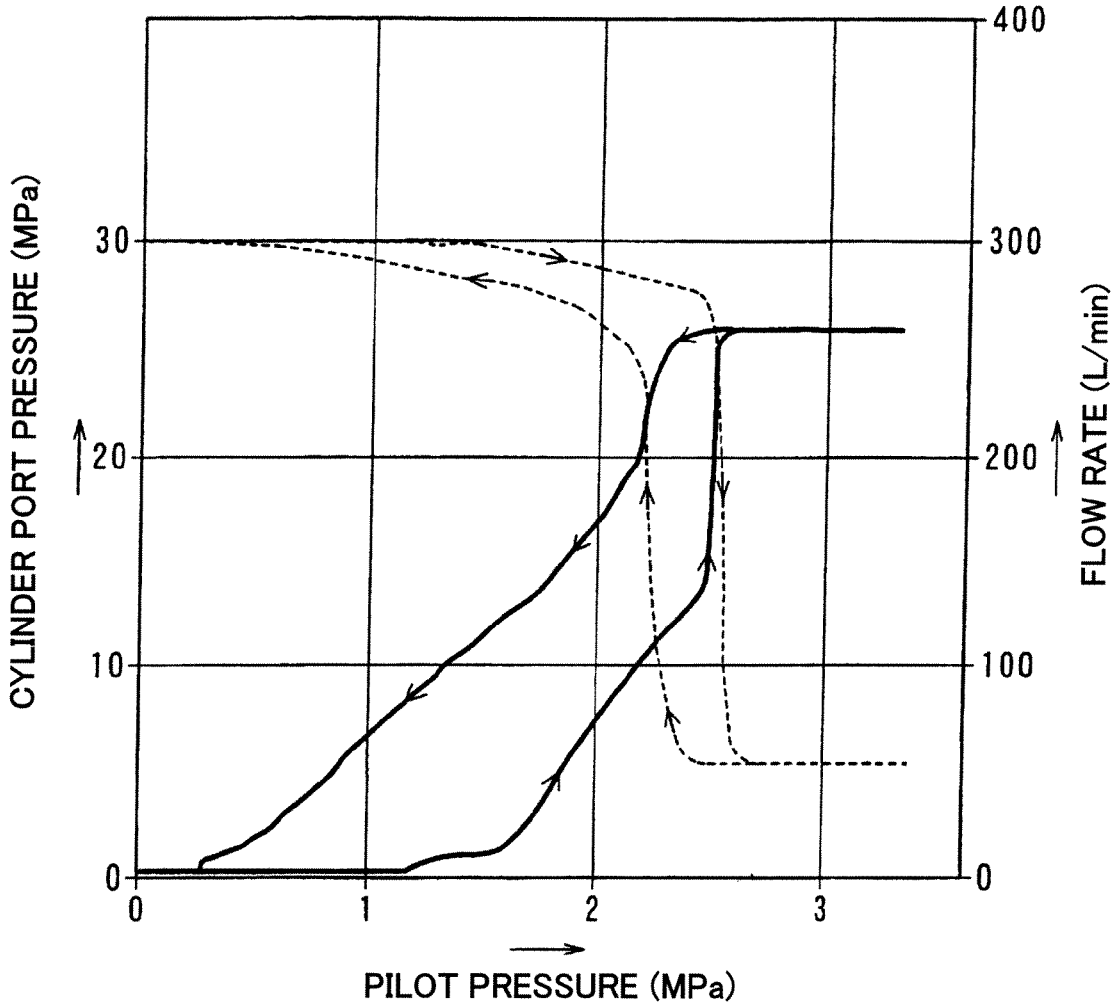
FIG. 8 is a graph showing actual measurement results of a relation among the pilot pressure, the cylinder port pressure, and the flow rate when the pilot pressure is applied in a state in which the relief valve of the conventional switching valve is open.

FIG. 6 is a cross-sectional view of a part of the holding control valve according to another embodiment of the present invention. The configuration of the piston 71 of the present embodiment is different from that of the above embodiment shown in FIG. 1. To be specific, the pilot piston 73 and the relief operation piston 72 have the same diameter as each other and are larger in diameter than the spool 70, and are arranged so as to be lined up along the axial direction of the through hole 32 (axial direction of the spool 70). As with the foregoing, the concave portion 73*d* that is the pilot oil storing space is formed between the lower surface of the pilot piston 73 and the upper surface of the plug 39, and the pilot pressure 5*b* is introduced to the concave portion 73*d*. The relief operation piston 72 is disposed on the pilot piston 73, and the relief oil is introduced from the relief valve 8 through the passage 11*aa* to between the pistons 72 and 73. Moreover, the orifice passages 72*b* and 73*e* are formed in the pistons 72 and 73, respectively. These orifice passages 72*b* and 73*e* constitute the communication passage extending from the surface of the pilot piston 73 which surface receives the pilot pressure 5*b* to the surface of the relief operation piston 72 which surface faces the spool 70.

Also in the present embodiment, the piston 71 is constituted by the relief operation piston 72 and the pilot piston 73. Therefore, even in a high pressure state by which the preleakage of the relief valve 8 occurs, it is possible to cause the opening start point of the pilot check valve 6 to follow the pilot pressure 5*b*, and stable handleability can be realized regardless of the load condition of the cylinder device 1. Moreover, the configurations of both the relief operation piston 72 and the pilot piston 73 are simple, so that processing cost does not become high. The other components are similar to those of the above embodiment, so that same reference numbers are used for the same or corresponding components, and explanations thereof are omitted.

The above embodiments have explained a case where the activated body is the cylinder device in the hydraulic operation apparatus, such as the hydraulic shovel. However, the activated body may be incorporated in the other hydraulic operation apparatus. Moreover, the configuration of the holding control valve is not limited to the configuration shown in FIG. 2, and may be any configuration as long as it reflects the configuration in the control circuit diagram shown in FIG. 4.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A holding control valve for use in a hydraulic control circuit configured to activate an activated body, comprising:

a pilot check valve connected to a pressure chamber of the activated body;

a switching valve configured to cause a spool to move against a spring force by introduction of pilot pressure in order to cause the pilot check valve to prevent flow of hydraulic oil from the pressure chamber of the activated body when pressure of a back pressure chamber of the pilot check valve is a load pressure of the pressure chamber of the activated body and in order to cause the pilot check valve to open to allow the flow of the hydraulic oil from the pressure chamber of the activated body when the hydraulic oil of the back pressure chamber of the pilot check valve is discharged; and a relief valve which is disposed on a branched passage branching from a connecting passage connecting the pressure chamber of the activated body and the pilot check valve, and whose relief oil exit is connected to a pilot pressure introducing portion of the switching valve, wherein:

the spool is configured to perform strokes by a piston configured to operate by the introduction of the pilot pressure and have a larger diameter than the spool;

the piston is divided into a pilot piston configured to receive the pilot pressure introduced to a storing space located on a side opposite to the spool side, and a relief operation piston separated from the storing space by the pilot piston and disposed adjacent to the spool to receive pressure of relief oil discharged when the relief valve operates; and the relief oil is introduced to between the pilot piston and the relief operation piston.

2. The holding control valve according to claim 1, wherein the relief operation piston has a same diameter as the spool, and is stored in a tubular portion formed on the pilot piston having a larger diameter than the spool.

3. The holding control valve according to claim 2, wherein:

a horizontal hole is formed on a tubular wall constituting the tubular portion of the pilot piston; and the relief oil is introduced through the horizontal hole to between the pilot piston and the relief operation piston.

4. The holding control valve according to claim 1, wherein the pilot piston and the relief operation piston have a same diameter as each other, and are arranged so as to be lined up.

5. The holding control valve according to claim 1, wherein a communication passage including an orifice is formed to extend from a surface of the pilot piston which surface receives the pilot pressure to a surface of the relief operation piston which surface faces the spool.

* * * * *